US009765597B2

(12) United States Patent
Simoneaux et al.

(10) Patent No.: US 9,765,597 B2
(45) Date of Patent: Sep. 19, 2017

(54) TUBULAR FLOW CONTROL APPARATUS AND METHOD OF PACKING PARTICULATES USING A SLURRY

(71) Applicants: Don N. Simoneaux, Washington, LA (US); Daniel J. Turick, Houston, TX (US)

(72) Inventors: Don N. Simoneaux, Washington, LA (US); Daniel J. Turick, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 251 days.

(21) Appl. No.: 14/663,747

(22) Filed: Mar. 20, 2015

(65) Prior Publication Data

US 2015/0300132 A1 Oct. 22, 2015

Related U.S. Application Data

(60) Provisional application No. 61/982,057, filed on Apr. 21, 2014.

(51) Int. Cl.
*E21B 43/08* (2006.01)
*E21B 43/04* (2006.01)

(52) U.S. Cl.
CPC ..... *E21B 43/086* (2013.01); *E21B 43/04* (2013.01)

(58) Field of Classification Search
CPC ..... E21B 43/04; E21B 43/086
See application file for complete search history.

(56) References Cited

U.S. PATENT DOCUMENTS 4,754,807 A 7/1988 Lange
6,405,800 B1 6/2002 Walker et al.
6,446,722 B2 * 9/2002 Nguyen ..... E21B 43/025 166/236
8,590,617 B2 * 11/2013 Nutley ..... E21B 33/1208 166/278

(Continued)

FOREIGN PATENT DOCUMENTS

EP 0622523 A2 11/1994
EP 0729543 B1 1/2006

OTHER PUBLICATIONS

Notification of Transmittal of the International Search Report and the Written Opinion of the International Searching Authority; PCT/US2015/021469; dated Jun. 23, 2015; Korean Intellectual Property Office; 12 pages.

(Continued)

*Primary Examiner* — Nicole Coy
*Assistant Examiner* — Jonathan Malikasim
(74) *Attorney, Agent, or Firm* — Cantor Colburn LLP

(57) ABSTRACT

A tubular flow control apparatus includes, a first screen surrounding a first tubular defining a first annular space therebetween, a second screen surrounding a second tubular defining a second annular space therebetween, and a third tubular positioned longitudinally between the first tubular and the second tubular having at least one passageway fluidically connecting the first annular space with the second annular space, the third tubular having at least one opening fluidically connecting the at least one passageway to a third space located radially outwardly of the third tubular.

14 Claims, 1 Drawing Sheet

(56) References Cited

U.S. PATENT DOCUMENTS

| | | | | |
|---|---|---|---|---|
| 8,602,096 | B2 * | 12/2013 | Olenick | E21B 43/086 166/157 |
| 2003/0029613 | A1 | 2/2003 | Danos et al. | |
| 2003/0089495 | A1 * | 5/2003 | Bixenman | E21B 43/086 166/265 |
| 2004/0140089 | A1 | 7/2004 | Gunneroed | |
| 2013/0233541 | A1 * | 9/2013 | Nutley | E21B 33/1208 166/278 |
| 2013/0277053 | A1 * | 10/2013 | Yeh | E21B 33/124 166/278 |

OTHER PUBLICATIONS

S. Saldanha, "Intelligent wells offer completion solution for Lower Teritary fields"; Offshore Drilling & Completion, Aug. 2012, 2 pages.

* cited by examiner

TUBULAR FLOW CONTROL APPARATUS AND METHOD OF PACKING PARTICULATES USING A SLURRY

BACKGROUND

Packing gravel in an annulus between concentric tubulars or between a tubular and the walls of an earth formation borehole is commonly done to, among other things, provide a filter media for produced hydrocarbons. Packing gravel is commonly accomplished by pumping a slurry of gravel and fluid through the annulus until it reaches an end of the annulus wherein it begins packing and thereby filling the annulus from there sequentially back towards the pumping source. By keeping the gravel well hydrated the slurry is able to flow like a fluid to fully fill and pack all areas of the annulus. The industry is therefore receptive to apparatuses and methods that help maintain hydration of a slurry while it is being pumped.

BRIEF DESCRIPTION

Disclosed herein is a tubular flow control apparatus. The apparatus includes, a first screen surrounding a first tubular defining a first annular space therebetween, a second screen surrounding a second tubular defining a second annular space therebetween, and a third tubular positioned longitudinally between the first tubular and the second tubular having at least one passageway fluidically connecting the first annular space with the second annular space, the third tubular having at least one opening fluidically connecting the at least one passageway to a third space located radially outwardly of the third tubular.

Further disclosed herein is a method of packing particulates using a slurry employing the tubular flow control apparatus of claim 1. The method includes flowing slurry longitudinally through an annulus defined between a structure and the tubular flow control apparatus, packing particulates within the slurry in the annulus sequentially from a downstream location toward an upstream location, and dehydrating particulates as they are packed by flowing fluid through the second screen through the at least one opening and through the first screen.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
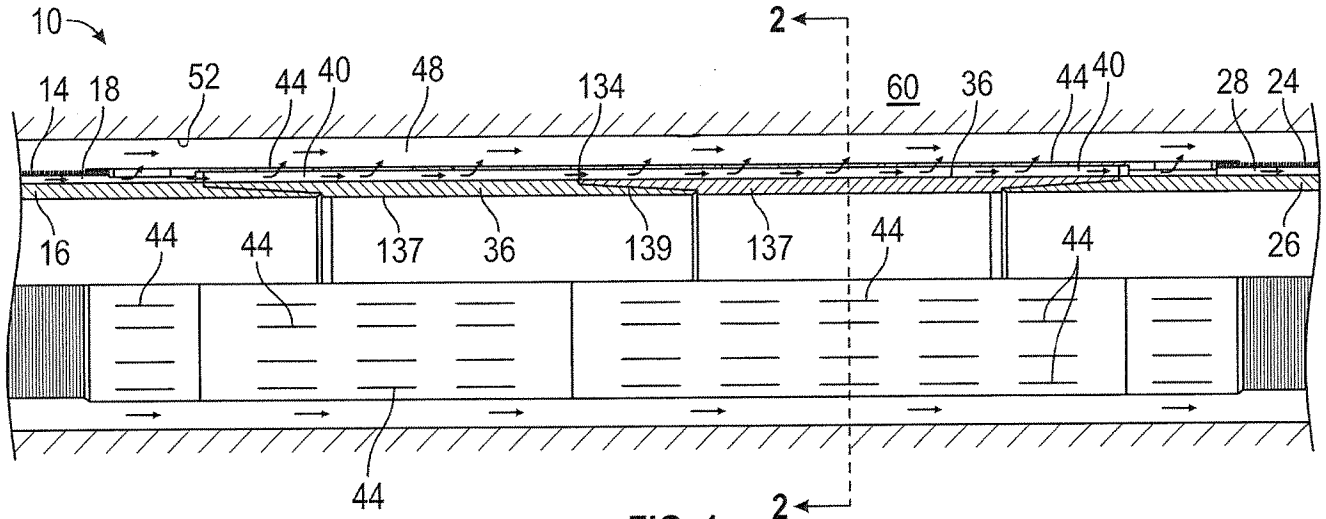
FIG. 1 depicts a quarter cross sectional view of a tubular flow control apparatus disclosed herein.

Referring to FIG. 1, an embodiment of a tubular flow control apparatus disclosed herein is illustrated at 10. The tubular flow control apparatus 10 includes a first screen 14 surrounding a first tubular 16 defining a first annular space 18 therebetween, a second screen 24 surrounding a second tubular 26 defining a second annular space 28 therebetween and one or more third tubulars 36 positioned longitudinally between the first tubular 16 and the second tubular 26. The third tubular 36 includes at least one passageway 40 that fluidically connects the first annular space 18 to the second annular space 28 and at least one opening 44 that fluidically connects the at least one passageway 40 to a third space 38 (e.g. an annulus) located radially outwardly of the third tubular 36.

Figure 2:
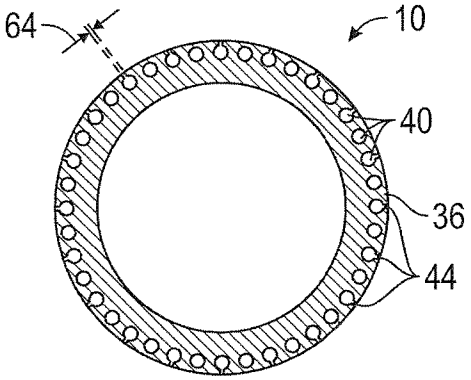
FIG. 2 depicts a cross sectional view of the tubular flow control apparatus of FIG. 1 taken at arrows 2-2.

Referring to FIG. 2 as shown in a cross section of the embodiment of FIG. 1 a plurality of the passageways 40 are bored longitudinally through the third tubular 36. The passageways 40 illustrated have a circular cross sectional shape as may be made when the passageways 40 are gun drilled through the third tubular 36. A plurality of the openings 44 fluidically connect a plurality of the passageways 40 to third space 38 defined between the tubular flow control apparatus 10 and a structure 52, such as an open hole, a casing or a liner in an earth formation 60, for example.

A dimension 64 of the openings 44 is sized to occlude passage of particulates (solids) greater than certain sizes that may be included in a slurry of gravel, sand or proppants and a fluid as can be employed during a gravel packing or fracking operation, for example. By setting the dimension 64 to occlude particulates that are as small as or smaller than particulates filtered out by the screens 14, 24, filtration is not altered. The dimension 64 can be a diameter in embodiments wherein the openings 44 are circular holes and may be a width of a slot in embodiments (such as the one illustrated) wherein the openings 44 are slots.

Figure 3:
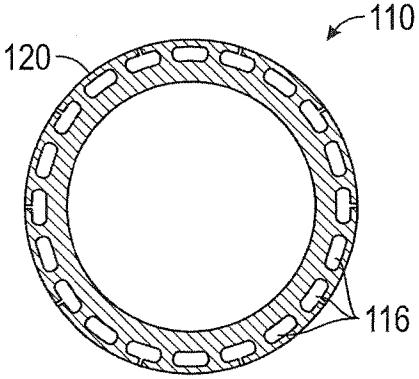
FIG. 3 depicts a cross sectional view of an alternate embodiment of a tubular flow control apparatus disclosed herein.

Referring to FIG. 3, an alternate embodiment of a tubular flow control apparatus disclosed herein is illustrated in cross section at 110. A primary difference between the apparatuses 110 and 10 is that the cross sectional shape of passageways 116 through a third tubular 120 in the apparatus 110 are noncircular. The passageways 116 have elongated cross sections with semicircular ends and are arc shaped. It should be noted that other embodiments could have alternate cross sectional shapes as well. Such shapes could be made by investment casting or electric discharge machining, for example. Additionally, while the embodiments of the third tubulars 36 and 120 are in the form of a multiple pieces connected together it should be noted that a single piece tubular, in alternate embodiments could also be employed. For example, a perforated tubular could be wrapped and attached to a base tubular having longitudinal grooves therein. In such an embodiment, the perforations in the perforated tubular would be the openings that would be aligned with to create fluidic communication with the grooves in the base tubular that form the passageways. Such a configuration could have passageways with a multitude of different cross sectional shapes. The illustrated embodiment shows the third tubular 36 as multiple parts, it can also be one piece. In embodiments wherein the third tubular 36 is one piece the gap 134 is not required.

Figure 1A:
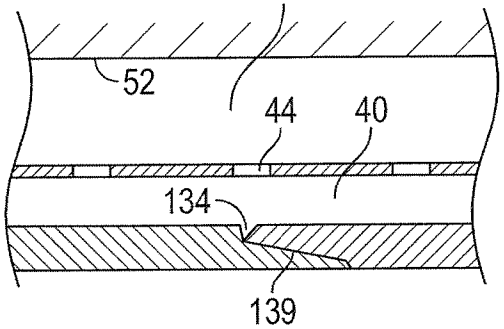
FIG. 1A is an enlarged view of a portion of FIG. 1.

Referring again to FIG. 1 and FIG. 1A, at least one gap 134 is formed in the third tubular 36. Although the gap 134 in this one embodiment is located between two parts 137 that are threadably attached together at threads 139 to form the third tubular 36, the gap 134 can be formed in various other ways including, drilling and milling, for example. How the gap 134 is formed can be strongly influenced by how the third tubular 36 is constructed. The gap 134 continues a full 360 degrees around the third tubular 36 and connects the passageways 116 or 40 to one another. The gap 134 can help balance distribution of fluid flow through the passageways 116 or 40 and eliminates the need of having the fluid passages 116 or 40 of the third tubular 36 be in alignment with the fluid passageways 116 on an axially opposing side of the gap 134.

The foregoing structures allow an operator to pack particulates in a slurry such as during a gravel packing operation in the downhole industry. Gravel packing is commonly done to provide a filter media for produced hydrocarbons and may also be used to support to the structure 52 while still allowing fluid to flow through the packed gravel. The process includes flowing a slurry longitudinally through the third space 38, such as from left to right in FIG. 1, for example. Packing particulates within the slurry in the annulus sequentially from a downstream location toward an upstream location, and dehydrating the particulates as they are packed by flowing fluid through the second screen through the at least one opening and through the first screen.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A third tubular positioned longitudinally between the first tubular and the second tubular having at least one passageway directly connecting the first annular space with the second annular space and configured to flow dehydrated fluid from the gravel slurry, the third tubular having at least one radially directed opening fluidically connecting the at least one passageway to a third space to be gravel packed located radially outwardly of the third tubular.

2. The tubular flow control apparatus of claim 1, wherein the at least one passageway is a plurality of passageways.

3. The tubular flow control apparatus of claim 2, wherein a gap fluidically connects a plurality of the plurality of passageways together.

4. The tubular flow control apparatus of claim 1, wherein the at least one opening is a plurality of openings.

5. The tubular flow control apparatus of claim 1, wherein the at least one opening is sized to prevent passage therethrough of particulates that are as small or smaller than particulates that are filtered out by at least one of the first screen and the second screen.

6. The tubular flow control apparatus of claim 1, wherein the at least one opening has a shape of an elongated slot.

7. The tubular flow control apparatus of claim 1, wherein the at least one passageway is a hole bored longitudinally through a wall of the third tubular.

8. The tubular flow control apparatus of claim 1, wherein a cross sectional shape of the at least one passageway is noncircular.

9. A method of packing particulates using a slurry employing the tubular flow control apparatus of claim 1 comprising:

flowing slurry longitudinally through an annulus defined between a structure and the tubular flow control apparatus;

packing particulates within the slurry in the annulus sequentially from a downstream location toward an upstream location; and dehydrating particulates as they are packed by flowing fluid through the second screen through the at least one opening and through the first screen.

10. The method of claim 9, further comprising flowing fluid longitudinally through at least one of the second annular space, the at least one passageway and the first annular space.

11. The method of claim 9, further comprising occluding flow of particulates through at least one of the second screen, the at least one opening and the first screen.

12. The method of claim 9, further comprising occluding particulates in the slurry from flowing through the at least one opening that are as small or smaller that are occluded from passing through at least one of the first screen and the second screen.

13. The method of claim 9, further comprising flowing fluid through a plurality of the at least one opening.

14. The method of claim 9, further comprising flowing fluid through a plurality of the at least one passageway.

* * * * *